US007380283B1

(12) United States Patent
Dumont

(10) Patent No.: US 7,380,283 B1
(45) Date of Patent: Jun. 3, 2008

(54) KNEE PADS FOR WORK PANTS AND ASSOCIATED METHOD

(76) Inventor: Clarence A. Dumont, 18469-97 A Avenue, Edmonton, AB (CA) T5T 3L6

( * ) Notice: Subject to any disclaimer, the term of this patent is extended or adjusted under 35 U.S.C. 154(b) by 0 days.

(21) Appl. No.: 11/639,036

(22) Filed: Dec. 14, 2006

(51) Int. Cl.
*A41D 13/00* (2006.01)

(52) U.S. Cl. ..... 2/23

(58) Field of Classification Search ..... 2/22, 2/24, 455, 911, 16, 271, 59, 46, 21; 128/878, 128/881, 882; 602/23, 26, 62
See application file for complete search history.

(56) References Cited

U.S. PATENT DOCUMENTS 4,561,123 A * 12/1985 Hull ..... 2/23
4,561,124 A 12/1985 Thompson
4,613,991 A 9/1986 Grover
5,592,689 A * 1/1997 Matthews ..... 2/23
5,732,412 A * 3/1998 Holden ..... 2/23
D393,141 S 4/1998 Glycenfer
5,896,580 A 4/1999 Aldrich et al.
5,920,902 A 7/1999 Crampton
6,070,267 A 6/2000 McKewin
6,317,888 B1 * 11/2001 McFarlane ..... 2/24
6,421,839 B1 7/2002 Vo et al.
6,584,616 B2 * 7/2003 Godshaw et al. ..... 2/24
6,708,342 B2 3/2004 Boersema
6,745,398 B1 6/2004 Hennessey

* cited by examiner

*Primary Examiner*—Tejash Patel
(74) *Attorney, Agent, or Firm*—Robert C. Montgomery

(57) ABSTRACT

The present invention includes at least one knee pad and an associated method of attaching work quality external kneepads onto work pants by an attachment fastener. The attachment fastener preferably includes a commercial quality hook and loop fastener. The present invention adapts a pair of conventional work trousers to accept, when needed, conventional padded knee protectors. By using hook and loop fasteners, the kneepads can be quickly and simply attached and detached without having uncomfortable straps around the leg and therefore overcomes prior art shortcomings of hindering blood circulation. Thus, the direct attachment to the pants in lieu of straps means that there are no straps to cut into legs or cut off circulation. An additional benefit to this system is the convenience of laundering the work clothes.

11 Claims, 4 Drawing Sheets

KNEE PADS FOR WORK PANTS AND ASSOCIATED METHOD

RELATED APPLICATIONS

The present invention was first described in Disclosure Document No. 590,449 filed on Nov. 22, 2005.

FIELD OF THE INVENTION

This invention relates to kneepads and, more particularly, to a combined pair of knee pads and work pants for preventing undesirably bunching of the work pants during operating conditions while protecting user knees from prolonged external forces acting thereon.

BACKGROUND OF THE INVENTION

Anyone who spends part or all of their day working on their knees knows how painful it is. The constant pressure, moving, sliding, leaning and the like all take part in causing great pain in the knee area. Such people include construction workers, floor refinishers, shelf stockers, roofers, janitorial personnel and the like. One common method of combating this pain is to wear external knee pads over their pants. While undoubtedly this provides cushioning while kneeling, the external knee pads pinch and bind the wearer's leg when standing. This quickly becomes an unsuitable solution for those who are constantly up and down off of their knees. Additionally, the use of external knee pads with this drawback usually requires them to be removed during breaks or while going for lunch thus spending time and effort to relocate them and put them back on after break or lunch is over. Accordingly, there is a need for a means by which people who spend a fair deal of their time on their knees working can be provided the comfort of knee pads without the appearance of wearing kneepads.

Several attempts have been made in the past to develop a combined pair of knee pads and work pants for preventing undesirably bunching of the work pants during operating conditions while protecting user knees from prolonged external forces acting thereon. U.S. Pat. No. 5,920,902 in the name of Crampton discloses a flexible closed-cell knee pad that is held in place between the inside of the knee area of a work pant leg and a rectangular fabric piece that is glued to pant leg. Since the fabric is attached to the pant leg by adhesive it is easy to install the knee pad on any kind of work pant without special tools or skills. Unfortunately, the use of adhesive in this prior art example prevents the knee pad from being repeatedly attached and detached. In addition, the adhesive may not function properly in cold weather conditions.

U.S. Pat. No. 6,745,398 in the name of Hennessey discloses safety pants with removable knee pads for providing a user with a pair of pants that would incorporate pockets which could house knee protection. The safety pants with removable knee pads include a pair of pants. The pants have a lower torso portion and two legs. Each of the legs has a front knee portion. Each one of a pair of pads has a size designed for covering one of the front knee areas. Each one of the pads provides a cushioning between a horizontal support surface and knees of a user when the user is in a kneeling position. A fastening assembly is for fastening each one of the pair of pads to an associated one of the legs for covering the knees of a user. Unfortunately, this prior art example requires a user to place the pads into pockets that are already attached to the work pants. Such pockets may not be at an optimal position for protecting the knees of a user.

U.S. Pat. No. 6,421,839 in the name of Vo, et al describes pants which include at least one pant leg and a pocket in the area of the knee. Within each pocket is to be located a cushioning pad. The cushioning pad is to be inserted through an access opening which has a length smaller than the width of the knee pocket which tends to prevent accidental dislodgment of the pad from the knee pocket. A securement device is to be connectable between the pad and the pant leg of the work pant. The knee pocket may be covered by a covering sheet to hopefully prevent the forming of wear holes within the knee area of the work pant. Unfortunately, such a pocket of this prior art example can be become torn during use, thereby being incapable of holding a knee pad in an optimal position for protection of a user knee. The pockets may also not be at an optimal position for protecting the knees of a user U.S. Pat. No. 6,070,267 in the name of McKewin discloses loops secured to the trousers sleeves of the wearer, on the exterior thereof, through which the knee pad straps are passed for holding the knee pad from sliding down the leg of the wearer. Unfortunately, the use of straps on this prior art example can cut off blood circulation to a user lower leg, thereby being uncomfortable and often painful for the user.

None of the prior art particularly describes a combined pair of knee pads and work pants for preventing undesirably bunching of the work pants during operating conditions while protecting user knees from prolonged external forces acting thereon. Accordingly, there is a need for an assembly which provides such features while overcoming the above-noted shortcomings.

SUMMARY OF THE INVENTION

In view of the foregoing disadvantages inherent in the prior art, it has been observed that there is need for a combined pair of knee pads and work pants for preventing undesirably bunching of the work pants during operating conditions while protecting user knees from prolonged external forces acting thereon.

The assembly includes a pair of work pants removably positional over the user knees, and a plurality of external kneepads advantageously disposed along an outer surface of the work pants. The assembly further includes a mechanism for removably attaching the kneepads to the work pants, which is essential such that the knee pads cover and protect the user knees during operating conditions. Such kneepads remain statically engaged with the work pants, which is critical such that the work pants are advantageously prohibited from bunching up against the kneepads when the kneepads are rubbed along the floor surface.

Each of the kneepads includes a durable protective shell and further includes a deformably resilient padded core statically and directly interfitted between the shells, without the use of intervening elements, which is crucial for absorbing the external forces during operating conditions. Each of such shells maintains a uniform shape, which is vital such that the padded cores are advantageously prohibited from bunching up inside of the shells respectively. Each of the shells completely envelopes an associated one of the padded cores, which is essential such that the work pants remain spaced from the padded cores respectively. Such shells are formed from non-corrosive material and further are machine washable. Of course, such shells can be formed from a variety of suitable non-corrosive and machine washable materials, as is obvious to a person of ordinary skill in the art. Such padded cores have corresponding thicknesses greater than respective thicknesses of the shells. Of course, such cores can be produced in a variety of thicknesses, as is obvious to a person of ordinary skill in the art.

Each of the kneepads further includes a bulbous section that has a plurality of pleats embedded thereon and that span along a curvilinear plane defined across front and rear faces of the kneepads. Such pleats are monolithically formed with the shells and thereby advantageously allow the kneepads to conform to the user knees. Such rear portions of the pleats maintain continuous frictional surface area contact with the work pants, which is important such that the work pants are fixedly gripped during operating conditions and advantageously prevented from bunching up during operating conditions. Each of the shells has a uniform and continuous thickness extending about an entire outer surface of an associated one of the padded cores. The rear surfaces of the kneepads are arcuately shaped which is critical such that an apex of the bulbous section is medially defined along an oppositely disposed front surface of the shells respectively.

The kneepad attaching mechanism includes a plurality of coextensively shaped hook fastener strips longitudinally mounted on front exterior surfaces of the work pants and positioned in proximity to corresponding knee areas thereof. The kneepad attaching mechanism further includes a plurality of coextensively shaped loop fastener strips longitudinally mounted on the rear surfaces of each of the shells, which is essential such that the loop fasteners directly engage the hook fasteners, without the use of intervening elements, when the kneepads are contiguously abutted against the work pants. Each of the kneepads is advantageously "U"-shaped for facilitating a fit of the kneepads to the user knees. Of course, such knee pads can be produced in a variety of shapes and sizes, as is obvious to a person of ordinary skill in the art.

The ability to attach the knee pads without the use of adhesives, and without the use of straps around a user legs, provides the unexpected benefits of allowing a user to attach the knee pads in all weather conditions, as well as prevent pain and discomfort associated with constricted blood flow in a user legs during operating conditions, thereby overcoming prior art shortcomings.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
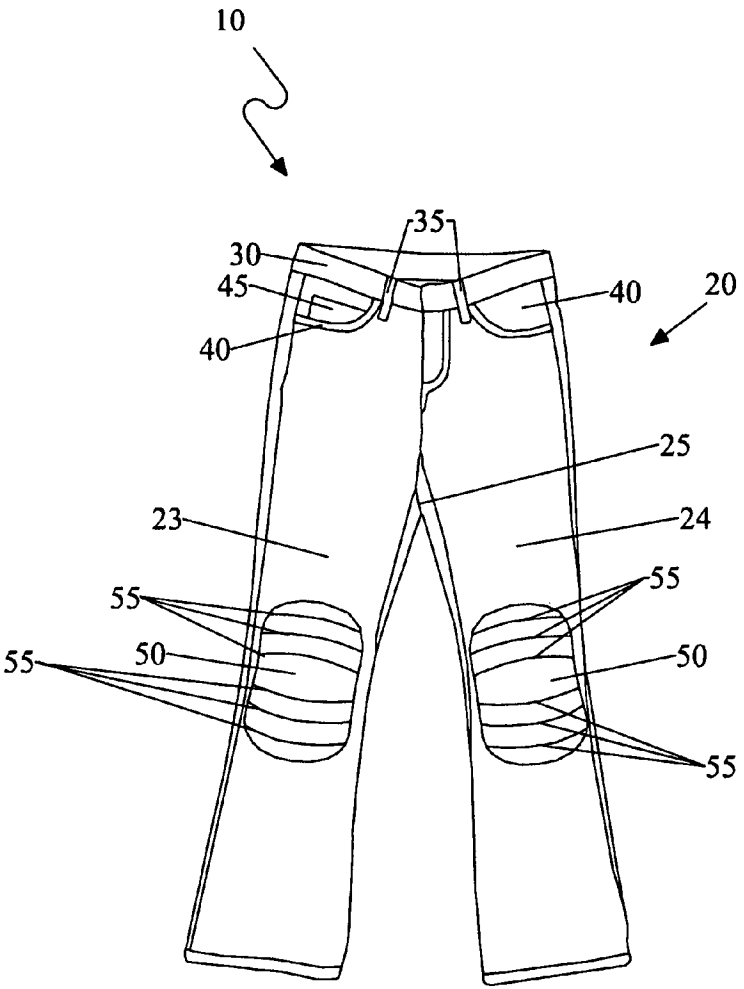
FIG. 1 is a front view of a knee pad system for work pants 10, according to the preferred embodiment of the present invention.

| | |
|---|---|
| 10 | knee pad system for work pants |
| 20 | work pants |
| 23 | left leg member |
| 24 | right Leg member |
| 25 | crotch area |
| 30 | waistband |
| 35 | belt loop |

-continued

| | |
|---|---|
| 40 | side pocket |
| 45 | inside pocket |
| 50 | kneepad |
| 55 | pleats |
| 58 | cushioning foam |
| 59 | protective shell |
| 60 | hook fastener strip |
| 65 | loop fastener strip |
| 70 | knee area |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a system and method of attaching work quality kneepads 50 externally onto work pants 20 by an attachment means. The knee pad system for work pants (herein described as the "system") 10 comprises a pair of work pants 20, integral external kneepads 50, and a means for attaching said kneepads 50 to said work pants 20. The system 10 is envisioned to be arranged as a "pant" type garment having a left leg member 23 and a right leg member 24. The work pants 20 are envisioned to be fabricated in a conventional manner by die cutting large quantities of textile material and sewing them together. The leg members 23, 24 may be fabricated of the same material as the main portion or selectively different or altered material having the same or different color and/or design. Type one (1) of the attachment means would be sewn, adhered, integrated, or otherwise attached onto the work pants 20 while type two (2) of the attachment means would be sewn, adhered, integrated, or otherwise attached onto the rear of the kneepads 50.

Figures 2, 2A:
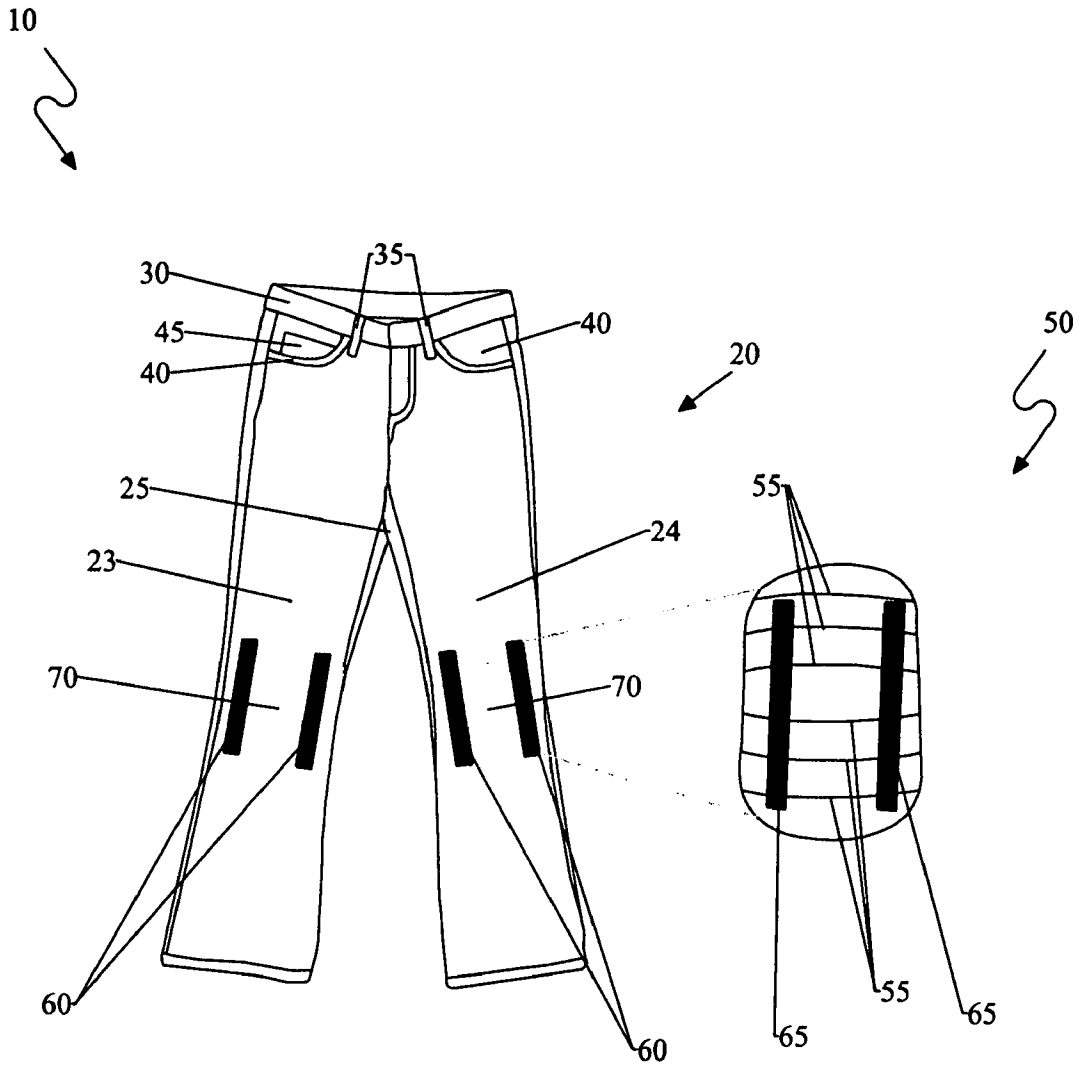
FIG. 2 is a front view of the work pants 20 with a kneepad 50 removably attached, according to the preferred embodiment of the present invention.
FIG. 2*a* is a close-up rear view of the kneepad 50, according to the preferred embodiment of the present invention.

Referring now to FIGS. 1 and 2, views of a pictorial representation of the system 10 for attachably removable features of the kneepads 50, are disclosed. The system 10 comprises a pair of work pants 20 preferably, but not essentially, fabricated and designed with heavyweight washable material, such as denim, to do inside and/or outside work. The work pants 20 are designed typically similar to that of conventional pants having a waistband 30, a left leg member 23, a right leg member 24, a plurality of variable sizeable pockets 40, 45, belt loops 30, and means to put on and take off the pants 20, i.e. button and zipper. As customary, the left leg member 23 is preferably, but not essentially, the mirrored image of the right leg member 24 fabricated and designed similarly.

The work pants 20 comprise a main portion to be conventionally fitted thereupon a lower torso of a user. The work pants 20 comprise an outer surface and an inner surface to be encompassing the full or partial lower torso of the user. The main portion comprises a waistband 30 to circumferentially fit along the waistline of the user. The main portion also comprises an insertion aperture and two (2) apertures positioned at the junction where the main portion convenes with leg members 23, 24, respectively, and dimensioned for removably receiving the legs of a user therethrough. As known in the art, the leg members 23, 24 are of tubular design and formed by two (2) panels sewn together providing an inseam and an outseam separated by a crotch area 25. Said leg members 23, 24 extend downwardly therefrom the crotch area 25 to a distal end intended to be in proximity thereto an ankle of a user.

The work pants 20 comprise a plurality of pockets 40, 45 positioned on the main portion including conventional side pockets 40 for removably receiving tools, writing utensils, or other objects while tapering downwardly for easy access. The pants 20 may also comprise pockets in the rear of said pants 20 and/or along the leg. Such pockets may vary in size and shape but are preferably large for receiving larger tools and/or objects. The side pocket 40 comprises an insert pocket 45 therewithin for receiving smaller objects. The pants 20 may also include a one (1) or more pockets and/or loops on the leg members, left 23 and right 24, (not pictured) to further facilitate the transportation of customary tools and/or marking utensils. Each pocket 40, 45 comprises preferably, but not essentially, an inner pocket section and an outer pocket section sewn together along the periphery leaving the top unfastened for removably receiving tools and/or other objects. Alternately, the edges may be folded to form the pockets 40, 45 to provide further wear and damage resistance.

The leg members 23, 24 comprise an area designated as a "knee area" 70 which typically is in proximity to a knee of a user when the work pants 20 are being worn. The system 10 provides knee protection to the knees of a user by providing reinforced kneepads 50 along the knee area 70. The kneepads 50 are removably attached thereto the front of the leg members 23, 24 such to cover and protect the knee area 70 and, consequently, the knees of a user. The kneepads 50 extend longitudinally along the central portion of the leg members 23, 24 such to extend further above the knee area 70 and further below the knee area 70 to serve optimum protection to the knees and portions of the leg adjacent to the knee area 70.

Figure 3:
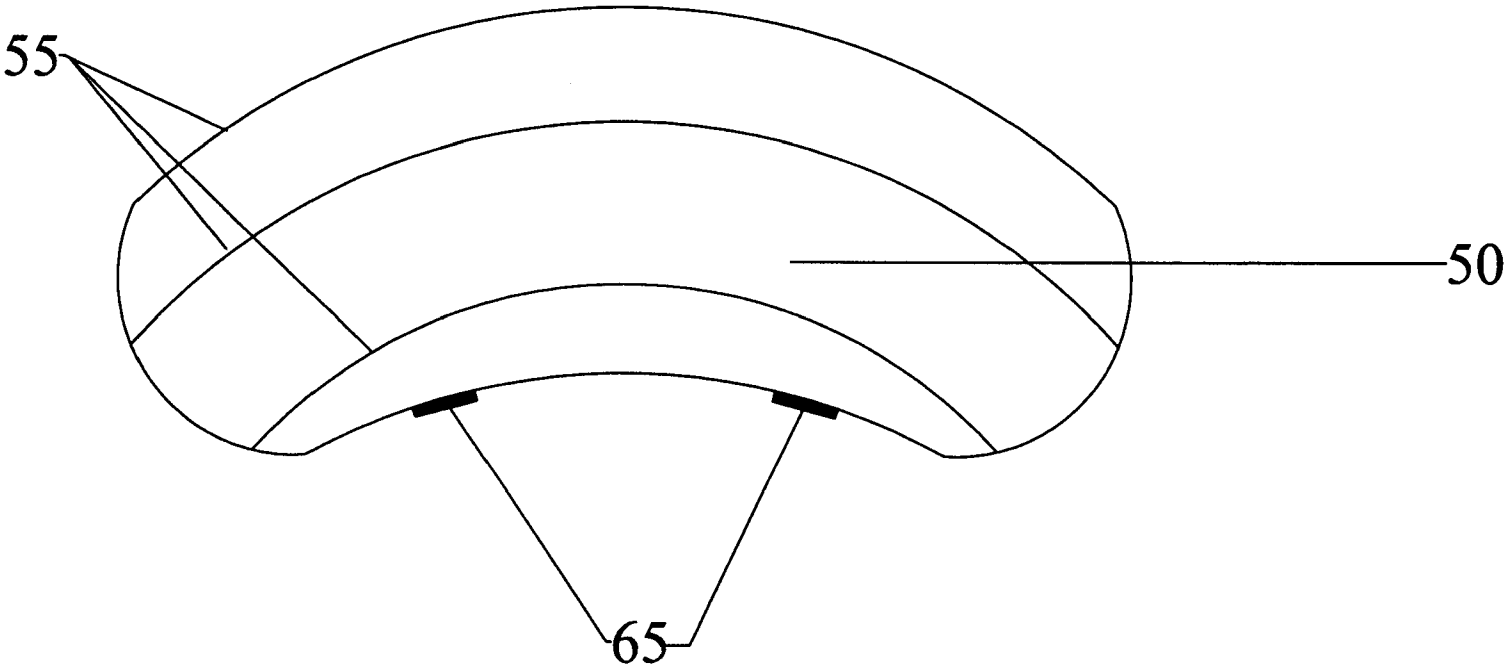
FIG. 3 is a top view of the kneepad 50, according to the preferred embodiment of the present invention.
Figure 4:
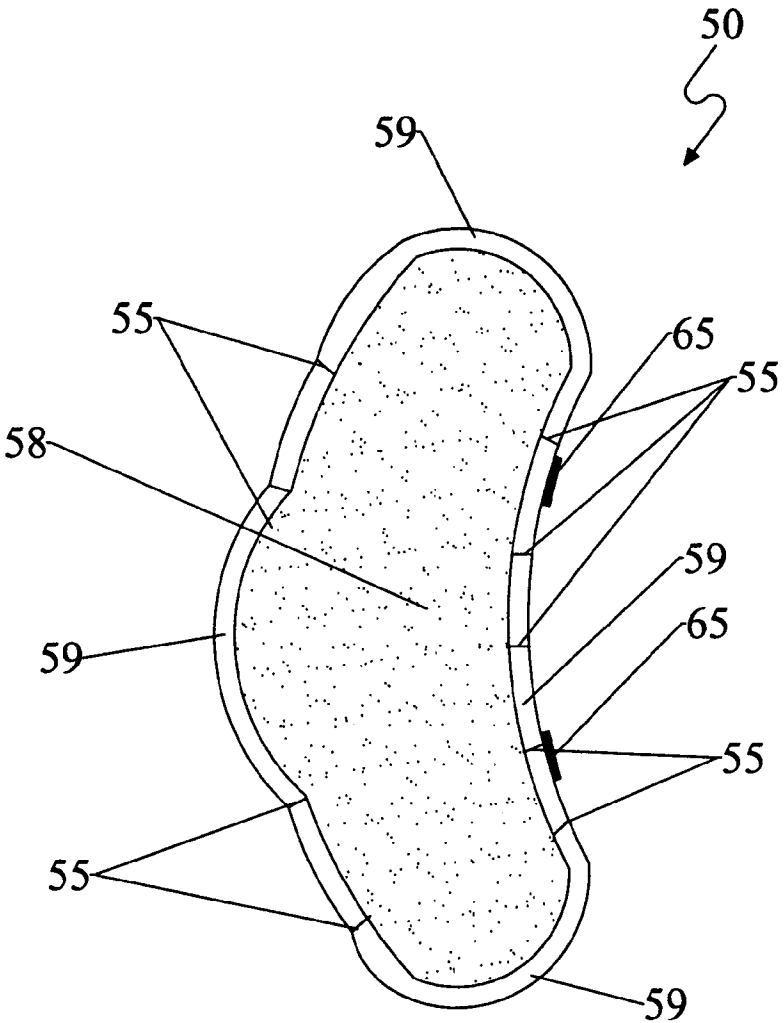
FIG. 4 is a transparent side view of the kneepad 50, according to the preferred embodiment of the present invention.

Referring now to FIGS. 3 and 4, top and side views of the kneepads 50, according to the preferred embodiment of the present invention, are disclosed. The kneepads 50 are preferably, but not essentially, layered to form padding that is easily reshaped to contour to the knee of the user while resisting "bunching" of the work pants 20 and/or said kneepads 50. The kneepads 50 are utilized as cushioning support on the knees of the user while in the kneeling position on a horizontal support surface or floor. The kneepads 50 are utilized to facilitate in the reduction of rubbing contact between the knee of the user and the floor by which he/she is kneeling thereby minimizing abrasions, discomfort, aches, pain, and the like.

As depicted in FIG. 3, the kneepad 50 is designed with a protective shell 59 enveloping cushioning padding or foam 58. The cushioning padding 58 is envisioned to be an elastomeric or rubbery padding or foam. The cushioning padding 58, such as polyurethane foam, is envisioned to be fabricated to meet the requirements of compression, tension, and strength while being flexible and resisting the "bunching up" or wrinkling-type collapse of the work pants 20. The cushioning foam 58 provides a high shock absorption permitting the ability to withstand the weight of a user with no relative motion inward toward the knee of the user and is designed to encompass high load-bearing capacity with superior abrasion resistance, high toughness properties, and the capability of functioning in a wide temperature range. The properties of the foam 58 permit a high modulus as well as high elongation for optimal loading capabilities.

In addition, the protective shell 59 envelops the cushioning foam 58 to further prevent damage and scratches to the kneepads 50 and/or the floor to which the knees are abutted thereagainst. The protective shell 59 is envisioned to be waterproof and/or weatherproof for machine washing and servicing; however, alternate embodiments of the present invention may comprise other suitable cushioning material 58 utilized for the application as opposed to polyurethane foam. Alternately, the complete removal of the kneepads 50 can be commenced prior to the machine-washing of the work pants. Thus, the kneepads 50 would be separately cleaned.

The kneepads 50 have a generally contoured "U"-shape for facilitating the fit of said kneepads 50 to the knees of the user. As depicted in FIGS. 3 and 4, the kneepads 50 comprise a bulbous section and a plurality of pleats 55 embedded thereon of the system 10 spanned curvilinear across the front and rear face of said kneepads 50. The pleats 55 are preferably, but not essentially, fabricated of the same materials as the protective shell 59. The pleats 55 allows the kneepads 50 to bend around and conform to the knee of the user, while still preventing "bunching up" of the work pants 20 functioning as a gripping aid for the sweep of the knee. Also, the pleats 55 permit movement of the leg and the knee while limiting relative movement of the kneepads 50. The pleats 55 allow angular flexing of the legs while working, standing, stretching, and/or getting into and out of the kneeling position while still contouring and maintaining the position of the kneepads 50 in the knee areas 70 of the user.

Two (2) hook fastener strips 60 are longitudinally mounted on the front exterior surface of the leg members 23, 24 in proximity to the knee area 70 for allowing the attachment of the kneepads 50. Two (2) loop fastener strips 65 are longitudinally mounted on the rear surface of the kneepads 50 for releasably engaging said hook fastener strips 60. The hook fastener strips 60 and the loop fastener strips 65 make up the hook-and-loop assembly which mate one (1) with the other so as to provide a mating fastener relationship 60, 65. The hook-and-loop fastener assembly 60, 65 also provides a plurality of kneepad 50 attachment areas longitudinally providing a wide-range of protection for the user with consideration that the knee area 70 may vary along the length of the leg members 23, 24. Thus the hook-and-loop fastener assembly 60, 65 prevents the tendency of movement of the kneepads 50 during the event of working, getting into and out of the kneeling position, standing, and stretching. The hook fastener strips 60 would be sewn, adhered, integrated, or otherwise attached onto the knee area 70 of the work pants 20 while the loop fastener strips 65 would be sewn, adhered, integrated, or otherwise attached onto the rear of the kneepads 50, as depicted in FIGS. 2 and 2*a*.

An alternate embodiment of the present invention 10 may disclose other fastener means for securing the kneepad 50 thereto the work pants 20 such as, but not limited to, zippers, snaps, buttons or other fastening mechanisms.

The preferred embodiment of the present invention can be utilized by the common user in a simple and effortless manner with little or no training. Likewise, experienced carpenters, maintenance workers, and do-it-yourselfers can find this invention 10 to greatly aid them in protective kneeling. After initial purchase or acquisition of the system 10, it would be configured as indicated in FIGS. 1 through 4.

The method of utilizing the device 10 may be achieved by performing the following steps: removably inserting one leg therethrough the leg member 23 of the work pants 20; removably inserting the opposing leg therethrough the opposing leg member 24 of the work pants 20 such that the button and zipper or fly are facing forwardly; fastening the work pants 20 thereon the lower torso by releasably fastening said button and fly; removably attaching the hook-and-loop assembly 60, 65 by engageably mating the loop fastener strips 65 of the one (1) kneepad 50 thereto the hook fastener strips 60 on the knee area 70 of a leg member 23, as needed; and, removably attaching the hook-and-loop assembly 60, 65 by engageably mating the loop fastener strips 65 of the other kneepad 50 thereto the hook fastener strips 60 on the knee area 70 of the other leg member 24, as needed.

In operation, the kneepads 50 serve to protect the knee and associated areas of the user while kneeling and from falling objects and the like.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A combined work pants and kneepad assembly for promoting comfortable work conditions by minimizing rubbing contact between user knees and a floor surface, said combined work pants and kneepad assembly comprising:

a pair of work pants removably positional over the user knees;

a plurality of external kneepads disposed along an outer surface of said work pants; and, means for removably attaching said kneepads to said work pants in such a manner that said kneepads cover and protect the user knees during operating conditions, said kneepads remaining statically engaged with said work pants such that said work pants are prohibited from bunching up against said kneepads when said kneepads are rubbed along the floor surface;

wherein each of said kneepads includes a durable protective shell and further includes a deformably resilient padded core statically and directly interfitted between said shell for absorbing the external forces during operating conditions, each of said shells maintaining a uniform shape such that said padded cores are prohibited from bunching up inside of said shells respectively; and, wherein each of said kneepads comprises a bulbous section having a plurality of pleats embedded thereon and spanning along a curvilinear plane defined across front and rear faces of said kneepads, said pleats being monolithically formed with said shells and thereby allowing said kneepads to conform to the user knees, rear portions of said pleats maintaining continuous frictional surface area contact with said work pants such that said work pants are fixedly gripped during operating conditions and prevented from bunching up during operating conditions.

2. The combined work pants and kneepad assembly of claim 1, wherein each of said shells completely envelopes an associated one of said padded cores such that said work pants remains spaced from said padded cores respectively, said shells being formed from non-corrosive material and further being machine washable.

3. The combined work pants and kneepad assembly of claim 1, wherein said kneepad attaching means comprises:

a plurality of coextensively shaped hook fastener strips longitudinally mounted on front exterior surfaces of said work pants and positioned in proximity to corresponding knee areas thereof; and, a plurality of coextensively shaped loop fastener strips longitudinally mounted on the rear surfaces of each of said shells such that said loop fasteners directly engage said hook fasteners when said kneepads are contiguously abutted against said work pants.

4. The combined work pants and kneepad assembly of claim 1, wherein each of said shells has a uniform and continuous thickness extending about an entire outer surface of an associated one of said padded cores, said rear surfaces of said kneepads being arcuately shaped wherein an apex of said bulbous section is medially defined along an oppositely disposed front surface of said shells respectively.

5. The combined work pants and kneepad assembly of claim 1, wherein each of said kneepads has a substantially "U"-shape for facilitating a fit of said kneepads to the user knees.

6. A combined work pants and kneepad assembly for promoting comfortable work conditions by minimizing rubbing contact between user knees and a floor surface, said combined work pants and kneepad assembly comprising:

a pair of work pants removably positional over the user knees;

a plurality of external kneepads disposed along an outer surface of said work pants; and, means for removably attaching said kneepads to said work pants in such a manner that said kneepads cover and protect the user knees during operating conditions, said kneepads remaining statically engaged with said work pants such that said work pants are prohibited from bunching up against said kneepads when said kneepads are rubbed along the floor surface;

wherein each of said kneepads includes a durable protective shell and further includes a deformably resilient padded core statically and directly interfitted between said shell for absorbing the external forces during operating conditions, each of said shells maintaining a uniform shape such that said padded cores are prohibited from bunching up inside of said shells respectively, wherein said padded cores have corresponding thicknesses greater than respective thicknesses of said shells; and, wherein each of said kneepads comprises a bulbous section having a plurality of pleats embedded thereon and spanning along a curvilinear plane defined across front and rear faces of said kneepads, said pleats being monolithically formed with said shells and thereby allowing said kneepads to conform to the user knees, rear portions of said pleats maintaining continuous frictional surface area contact with said work pants such that said work pants are fixedly gripped during operating conditions and prevented from bunching up during operating conditions.

7. The combined work pants and kneepad assembly of claim 6, wherein each of said shells completely envelopes an associated one of said padded cores such that said work pants remains spaced from said padded cores respectively, said shells being formed from non-corrosive material and further being machine washable.

8. The combined work pants and kneepad assembly of claim 6, wherein said kneepad attaching means comprises:

a plurality of coextensively shaped hook fastener strips longitudinally mounted on front exterior surfaces of said work pants and positioned in proximity to corresponding knee areas thereof; and, a plurality of coextensively shaped loop fastener strips longitudinally mounted on the rear surfaces of each of said shells such that said loop fasteners directly engage said hook fasteners when said kneepads are contiguously abutted against said work pants.

9. The combined work pants and kneepad assembly of claim 6, wherein each of said shells has a uniform and continuous thickness extending about an entire outer surface of an associated one of said padded cores, said rear surfaces of said kneepads being arcuately shaped wherein an apex of said bulbous section is medially defined along an oppositely disposed front surface of said shells respectively.

10. The combined work pants and kneepad assembly of claim 6, wherein each of said kneepads has a substantially "U"-shape for facilitating a fit of said kneepads to the user knees.

11. A method for protecting user knees during prolonged surface area contact against a hard floor surface, said method comprising the steps of:

a. removably inserting one leg through a leg member of a pair of work pants;

b. removably inserting an opposing leg through an opposing leg member of said work pants such that a button and a zipper of said work pants are facing outwardly;

c. fastening said work pants over a lower torso of a user by releasably fastening said button and said zipper respectively;

d. obtaining a pair of kneepads having a bulbous section provided with a plurality of pleats embedded thereon and spanning along a curvilinear plane defined across front and rear faces of said kneepads, said pleats being monolithically formed with outer shells of said kneepads and thereby allowing said kneepads to bend and conform to the user knees, rear portions of said pleats maintaining continuous surface area contact with said work pants and defining a frictional surface along which said work pants are gripped during operating conditions; and, e. removably attaching said kneepads to a knee area of said work pants by mating a plurality of coextensively shaped loop fastener strips to a corresponding pair of hook fastener strips, said loop fasteners strips being permanently coupled directly to a rear surface of said kneepads and said hook fastener strips being connected to the knee area of said work pants.

* * * * *